US009795996B2

(12) United States Patent
Adams et al.

(10) Patent No.: US 9,795,996 B2
(45) Date of Patent: Oct. 24, 2017

(54) METHOD AND APPARATUS FOR SORTING

(71) Applicants: Dirk Adams, Tongeren (BE); Johan Calcoen, Leuven (BE); Timothy L. Justice, Walla Walla, WA (US); Gerald R. Richert, Walla Walla, WA (US)

(72) Inventors: Dirk Adams, Tongeren (BE); Johan Calcoen, Leuven (BE); Timothy L. Justice, Walla Walla, WA (US); Gerald R. Richert, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 0 days.

(21) Appl. No.: 14/997,173

(22) Filed: Jan. 15, 2016

(65) Prior Publication Data

US 2016/0129480 A1 May 12, 2016

Related U.S. Application Data

(62) Division of application No. 14/317,551, filed on Jun. 27, 2014, now Pat. No. 9,266,148.

(51) Int. Cl.

| | |
|---|---|
| ***B07C 5/00*** | (2006.01) |
| ***B07C 5/342*** | (2006.01) |
| ***B07C 5/34*** | (2006.01) |

(52) U.S. Cl.

CPC ..... *B07C 5/342* (2013.01); *B07C 5/34* (2013.01); *B07C 5/3422* (2013.01); *B07C 5/3425* (2013.01)

(58) Field of Classification Search

CPC ..... B07C 5/34; B07C 5/342; B07C 5/3422; B07C 5/3452

USPC ..... 209/938, 552, 577, 576

See application file for complete search history.

(56) References Cited

U.S. PATENT DOCUMENTS

| | | | | |
|---|---|---|---|---|
| 4,369,886 | A | 1/1983 | Lane et al. | |
| 4,834,870 | A | 5/1989 | Osterberg et al. | |
| 5,471,311 | A | 11/1995 | van den Bergh et al. | |
| 5,659,624 | A * | 8/1997 | Fazzari | B07C 5/3422 209/580 |
| 5,675,419 | A | 10/1997 | van den Bergh et al. | |
| 5,761,070 | A * | 6/1998 | Conners | B07C 5/3422 345/426 |
| 5,954,206 | A * | 9/1999 | Mallon | B07C 5/342 209/580 |
| 6,016,194 | A | 1/2000 | Girvin et al. | |
| 6,060,677 | A * | 5/2000 | Ulrichsen | B07C 5/342 209/577 |
| 6,734,383 | B1 | 5/2004 | Calcoen et al. | |
| 7,292,949 | B2 | 11/2007 | Ding | |
| 7,326,871 | B2 | 2/2008 | Kenny et al. | |
| 7,541,557 | B2 * | 6/2009 | Voloshyn | B03B 13/04 209/552 |

(Continued)

OTHER PUBLICATIONS

PCT International Search Report dated Aug. 17, 2015.

*Primary Examiner* — Terrell Matthews
(74) *Attorney, Agent, or Firm* — Randall Danskin P.S.

(57) ABSTRACT

A method and apparatus for sorting objects is described, and which provides high-speed image data acquisition to fuse multiple data streams in real-time, while avoiding destructive interference when individual sensors or detectors are utilized in providing data regarding features of a product to be inspected.

13 Claims, 10 Drawing Sheets

(56) References Cited

U.S. PATENT DOCUMENTS

| | | | | |
|---|---|---|---|---|
| 7,855,348 | B2 * | 12/2010 | Goodwin | G06K 9/2018 209/584 |
| 8,083,066 | B2 | 12/2011 | Bourely | |
| 8,253,054 | B2 | 8/2012 | Koehler et al. | |
| 8,283,589 | B2 | 10/2012 | Janssens et al. | |
| 8,794,447 | B2 | 8/2014 | Van Kasteren | |
| 8,902,416 | B2 | 12/2014 | Klokkerud et al. | |
| 2011/0202169 | A1 * | 8/2011 | Koehler | B07C 5/342 700/215 |
| 2012/0138514 | A1 * | 6/2012 | Janssens | G01N 21/21 209/577 |
| 2015/0160128 | A1 * | 6/2015 | Liu | G01N 21/55 356/445 |
| 2015/0377427 | A1 * | 12/2015 | Richert | F21K 9/00 362/218 |
| 2016/0252461 | A1 | 9/2016 | Balthasar et al. | |

* cited by examiner

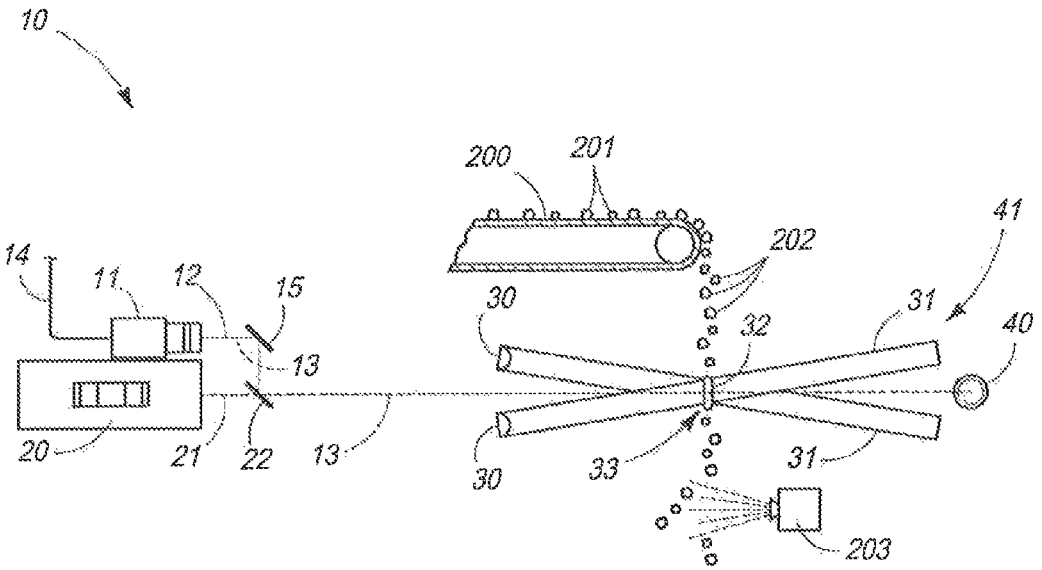
FIG. 1E
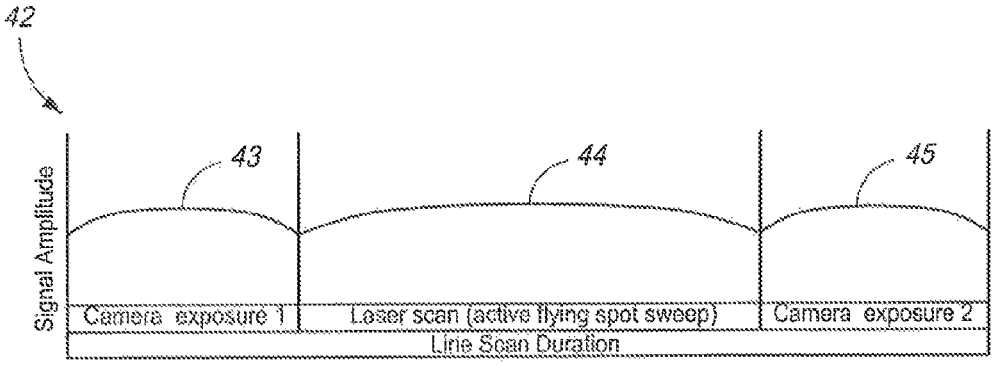
FIG. 1E1

METHOD AND APPARATUS FOR SORTING

TECHNICAL FIELD

The present invention relates to a method and apparatus for sorting, and more specifically to a method and apparatus for sorting a stream of products, and wherein the methodology and apparatus generates multi-modal, multi-spectral images which contain up to eight or more simultaneous channels of data which contain information on color, polarization, fluorescence, texture, translucence, and other information which comprises many aspects or characteristics of a feature space, and which further can be used to represent images of objects for identification, and feature and flaw detection.

BACKGROUND OF THE INVENTION

It has long be known that camera images including, line scan cameras are commonly combined with laser scanners or LIDAR and/or time of flight imaging for three dimensional viewing, and which is used to perceive depth, and distance, and to further track moving objects, and the like. Such devices have been employed in sorting apparatuses of various designs in order to identify acceptable and unacceptable objects, or products, within a stream of products to be sorted, thus allowing the sorting apparatus to remove undesirable objects in order to produce a homogeneous resulting product stream which is more useful for food processors, and the like. Heretofore, attempts which have been made to enhance the ability to image objects effectively, in real-time, have met with somewhat limited success. In the present application, the term "real-time" when used in this document, relates to the processing which occurs within the span of, and substantially at the same rate, as that which is depicted. In the present application "real-time" may include several micro-seconds to a few milliseconds. One of the chief difficulties associated with such efforts has been that when particular detectors, sensors, and the like have been previously employed, and then energized both individually and, in combination with each other, they have undesirable affects and limitations including, but not limited to, lack of isolation of the signals of different modes, but similar optical spectrum; unwanted changes in the response per optical angle of incidence, and field angle; a severe loss of sensitivity or effective dynamic range of the sensor being employed, among many others. Thus, the use of many sensors or interrogating means for providing information regarding the objects being sorted, when actuated, simultaneously, often destructively interfere with each other thus limiting the ability to identify features or characteristics of an object which would be helpful in classifying it as being either, on the one hand, an acceptable product or object, or on the other hand, unacceptable, and which needs to be excluded from the product stream.

While the various prior art devices and methodology which have been used, heretofore, have worked with various degree of success, assorted industries such as food processors, and the like, have searched for enhanced means for discriminating between products or objects traveling in a stream so as to produce ever better quality products, or resulting products having different grades, for subsequent supply to various market segments.

A method and apparatus for sorting which avoids the detriments associated with the various prior art teachings, and practices utilized, heretofore, is the subject matter of the present application.

SUMMARY OF THE INVENTION

A first aspect of the present invention relates to a method for sorting which includes providing a stream of individual products to be sorted, and wherein the individual products have a multitude of characteristics; moving the stream of individual products through an inspection station; providing a plurality of detection devices in the inspection station for identifying the multitude of characteristics of the individual products, and wherein the respective detection devices, when actuated, generate a device signal, and wherein at least some of the plurality of detection devices if actuated, simultaneously, interfere in the operation of other actuated detection devices; providing a controller for selectively actuating the respective detection devices in a predetermined order, and in real-time, so as to prevent interference in the operation of the selectively actuated detection devices; delivering the device signals generated by the respective detection devices to the controller; forming a real-time, multiple-aspect representation of the individual products passing through the inspection station with the controller by utilizing the respective device signals generated by the detection device, and wherein the multiple-aspect representation has a plurality of features formed from the characteristics detected by the respective detection devices; and sorting the individual products based, at least in part, upon the multiple aspect representation formed by the controller, in real-time, as the individual products pass through the inspection station.

Still another aspect of the present invention relates to a sorting apparatus which includes a source of individual products to be sorted; a conveyor for moving the individual products along a given path of travel, and into an inspection station; a plurality of selectively energizable illuminators located in different, spaced, angular orientations relative to the inspection station, and which, when energized, individually emit electromagnetic radiation which is directed towards, and reflected from and/or transmitted through, the respective products passing through the inspection station; a plurality of selectively operable image capturing devices which are located in different, spaced, angular orientations relative to the inspection station, and which, when rendered operable, captures the reflected and/or transmitted electromagnetic radiation from the individual products passing through the inspection station, and forms an image of the electromagnetic radiation which is captured, and wherein the respective image capturing devices each form an image signal; a controller coupled in controlling relation relative to each of the plurality of illuminators, and image capturing devices, and wherein the image signal of each of the image capturing device is delivered to the controller, and wherein the controller selectively energizes individual illuminators, and image capturing devices in a predetermined sequence so as generate multiple image signals which are received by the controller, and which are combined into a multiple aspect image, in real-time, and which has multiple measured characteristics, and gradients of the measured characteristics, and wherein the multiple aspect image which is formed allows the controller to identify individual products in the inspection station having a predetermined feature; and a product ejector coupled to the controller and which, when actuated by the controller, removes individual products from the inspection station having features identified by the controller from the multiple aspect image.

Yet another aspect of the present invention relates to a method of sorting which includes providing a source of a product to be sorted; providing a conveyor for moving the source of the product along a path of travel, and through a downstream inspection station; providing a first, selectively energizable illuminator which is positioned to a first side of the product stream, and which, when energized, illuminates the product stream moving through the inspection station; providing a first, selectively operable image capturing device which is operably associated with the first illuminator, and which is further positioned on the first side of the product stream, and which, when actuated, captures images of the illuminated product stream moving through the inspection station; providing a second, selectively energizable illuminator which is positioned on the first side of the product stream, and which, when energized, emits a narrow beam of light which is scanned along a path of travel, and across the product stream moving through the inspection station; providing a second, selectively operable image capturing device which is operably associated with the second illuminator, and which is further positioned on the first side of the product stream, and which, when actuated, captures images of the product stream illuminated by the narrow beam of light emitted by the second selectively energizable illuminator; optionally providing a third, selectively energizable illuminator which is positioned on the second side of the product stream, and which, when energized illuminates the product stream moving through the inspection station; providing a third, selectively operable image capturing device which is operably associated with the second illuminator, and which is further positioned on the second side of the product stream, and which, when actuated, captures images of the illuminated product stream moving through the inspection station; optionally providing a fourth selectively energizable illuminator which is positioned on the second side of the product stream, and which, when energized, emits a narrow beam of light which is scanned along a path of travel, and across the product stream moving through the inspection station; providing a fourth, selectively operable image capturing device which is operably associated with the fourth illuminator, and which is further positioned on the second side of the product stream, and which, when actuated, captures images of the product stream illuminated by the narrow beam of light emitted by the second selectively energizable illuminator, and generating with the first, second and optionally third and fourth image capturing devices, multimodal, multidimensional images formed of the images generated by the first, second, and optionally third and fourth image capturing devices; providing a controller and electrically coupling the controller in controlling relation relative to each of the first, second, and optionally third and fourth illuminators, and image capturing devices, respectively, and wherein the controller is operable to individually, and sequentially energize, and then render operable the respective first, second, third and fourth illuminators, and associated image capturing devices, in a predetermined pattern, so that only one illuminator or a predetermined combination of illuminators, and associated image capturing devices are energized or rendered operable, during a given time period, and wherein the controller further receives the respective image signals generated by the respective first, second, and optionally third and fourth image capturing devices, and which depicts the product stream passing through the inspection station, and wherein the controller analyzes the respective image signals of the first, second, and optionally third and fourth image capturing devices, and identifies any unacceptable product moving along the product stream, and generates a product ejection signal; and providing a product ejector positioned downstream of the inspection station, and which receives the product ejection signal, and is operable to remove any unacceptable product moving along in the product stream.

Still another aspect of the present invention relates to a method for sorting a product which includes providing a source of a product to be sorted; transporting the source of product along a predetermined path of travel, and releasing the source of product into a product stream which moves in an unsupported gravity influenced free-fall trajectory; providing an inspection station which is located along the trajectory of the product stream; providing a first, selectively energizable illuminator, and locating the first illuminator on the first side of the product stream, and the inspection station, respectively; providing a first, selectively operable image capturing device and locating the first image capturing device adjacent to the first illuminator; energizing the first illuminator, and rendering the first image capturing device operable substantially simultaneously, for a first predetermined time period so as to illuminate the product stream moving through the inspection station, and generate an image signal with the first image capturing device of the illuminated product stream; providing a second, selectively energizable illuminator, and locating the second illuminator on the first side of the product stream, and in spaced relation relative to the first illuminator; providing a second, selectively operable image capturing device, and locating the second image capturing device adjacent to the second illuminator; energizing the second illuminator so as to generate a narrow beam of light which is scanned along a path of travel which is transverse to the product stream moving through the inspection station, and further rendering the second image capturing device operable, substantially simultaneously, for a second predetermined time period, which is subsequent to the first predetermined time period, and wherein the second illuminator illuminates, with the narrow beam of light, the product stream which is moving through the inspection station, and the second image capturing device generates an image signal of the illuminated product stream; optionally providing a third, selectively energizable illuminator which is positioned on the second side of the product stream, and which, when energized, illuminates the product stream moving through the inspection station; optionally providing a third, selectively operable image capturing device, and locating the third image capturing device adjacent to the third illuminator; energizing the third illuminator, and rendering the third image capturing device simultaneously operable, for a third predetermined time period, so as to illuminate the product stream moving through the inspection station while simultaneously forming an image signal with the third image capturing device of the illuminated product stream, and wherein third predetermined time period is subsequent to the first and second predetermined time periods; optionally providing a fourth, selectively operable image capturing device, and locating the fourth image capturing device adjacent to the fourth illuminator; energizing the fourth illuminator so as to generate a narrow beam of light which is scanned along a path of travel which is transverse to the product stream moving through the inspection station, and further rendering the fourth image capturing device operable, substantially simultaneously, for a fourth predetermined time period, which is subsequent to the second predetermined time period, and wherein the fourth illuminator illuminates, with the narrow beam of light, the product stream which is moving through the inspection station, and the fourth image capturing device generates an image signal of the illuminated product stream; providing a controller and coupling the controller in controlling relation relative to each of the first, second and optionally third and fourth illuminators, and image capturing devices, respectively; providing and electrically coupling an image preprocessor with the controller; supplying the image signals formed by the respective first, second and optionally third and fourth image capturing devices, to the image preprocessor; processing the image signals received by the preprocessor and supplying the image signals to the controller to identify a defective product in the product stream passing through the inspection station, and wherein the controller generates a product ejection signal when a defective product is identified; and providing a product ejector which is located downstream of the inspection station, and along the trajectory of the product stream, and wherein the controller supplies the product ejection signal to the product ejector to effect a removal of the identified defective product from the product stream.

These and other aspects of the present invention will be discussed in greater detail hereinafter.

BRIEF DESCRIPTION OF THE DRAWINGS

Preferred embodiments of the invention are described below with reference to the following accompanying drawings.

FIG. 1E is a greatly simplified, schematic view of a first form of the present invention.

FIG. 1E1 is a greatly simplified, graphical depiction of the operation of the first form of the present invention.

DETAILED DESCRIPTION OF THE PREFERRED EMBODIMENTS

Figure 1A:
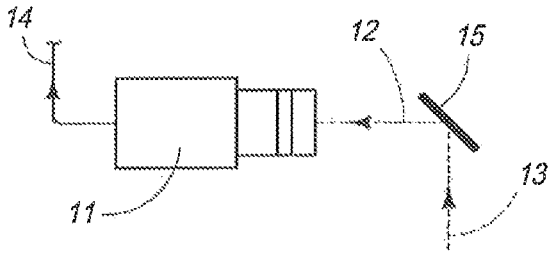
FIG. 1A is a greatly simplified, side elevation view of a camera located in spaced relation relative to a mirror.

This disclosure of the invention is submitted in furtherance of the constitutional purposes of the U.S. Patent Laws "to promote the progress of science and useful arts." (Article I, Section 8).

As noted earlier in the specification the known benefits and relative strengths of camera imaging and laser scanning, and how these specific forms of product interrogation can be complimentary when used for product sorting applications are well known. It is now practical to combine high speed image data acquisition with sufficiently powerful computational and/or image processing capability to fuse multiple data streams in real-time, that is, with response times of several microseconds, to a few milliseconds, to generate useful images of objects traveling in a product stream. However, as noted earlier in this application, numerous problems exist when detectors or interrogators of various designs are used in different modes of operation. It is well known that these modes of operation are often not normally or naturally compatible with each other without some loss of information or destructive signal interference. Furthermore, in optical applications, traditionally used means for spatially or spectrally separating signals often are not sufficient to isolate detector signals from destructive interference with each other. Consequently, the present application discloses a new way of controlling and acquiring multi-modal and multi-dimensional image features of objects requiring inspection. As noted above, it is well known that destructive interference often occurs between cameras and laser scanners which are operated simultaneously and in close proximity, or relative one to the other.

Those skilled in the art will recognize that spectral isolation is not practical for high order, flexible and/or affordable multi-dimensional detector or interrogator channel fusion. This is due, in large measure, to dichroic costs, and the associated sensitivity of angle of incidence and field angles relative to spectral proximity of desirable camera and laser scanner channels. Additional problems present themselves in managing "stacked tolerances" consisting of tightly coupled multi-spectral optical and optoelectronic components.

In addition to the problems noted earlier in this Application with regard to conventional detection and interrogation means used to inspect a stream of products, it is known that dynamic, spatial variances for products traveling as high speed bulk particulate, cannot be corrected or compensated, in real-time, by any conventional means. Consequently, traditional approaches to combine camera, and laser scanning through the separation, in time, or space, cannot support the generation of real-time pixel level, multi-modal image data utilization or fusion.

Those skilled in the art will recognize that the relationship between reflected, transmitted and absorbed electromagnetic energy, and their respective interactions with individual products moving in a product stream, provides assorted opportunities for non-destructive interrogation of individual objects moving in the stream, so as to determine the identity and quality of the product being inspected or sorted. Those skilled in the art will also recognize that there are known limits to acquiring reflected and transmitted electromagnetic radiation simultaneously. In particular, it's known that the product of reflection and transmission does not allow, under current conditions, measuring reflection and transmission of the electromagnetic radiation, independently. However, the present invention provides a solution to this dilemma, whereby, measured reflectance and transmission of electromagnetic radiation may be made substantially, simultaneously, and in real-time, so as to provide an increased level of data available and upon which sorting decisions can be made. In the present invention, the method and apparatus, as described below, provides an effective means for forming, and fusing image channels from multiple detectors and interrogators using three approaches. These approaches include a spectral, spatial, and a temporal [time] approach. With regard to the first approach, that being a spectral approach, the present method and apparatus, as described below, is operable to allocate wavelengths of electromagnetic radiation [whether visible or invisible] by an appropriate selection of a source of electromagnetic radiation, and the use of optical filters. Further in this spectral approach, the provision of laser scanner and camera illumination spectra is controlled. Still further, a controller is provided, as will be discussed, hereinafter, and which is further operable to adjust the relative color intensity of camera illumination which is employed. Still further the spectral approach which forms and/or fuses image channels from multiple detectors, also coordinates the detection spectra so as to optimize contrast features, and the number of possible detector channels which are available to provide data for subsequent combination.

With regard to the spatial approach, as mentioned above, this approach, in combination with the spectral and temporal approaches, which will be discussed, includes a methodology having a step of providing coincident views from the multiple detectors to support image data acquisition or fusion. Secondly, the spatial approach includes a step for the separation of the multiple detectors, and related detection zones to reduce destructive interference from sensors having incompatible operational characteristics. Yet further, the spatial approach includes a step of adjusting the illumination intensity, and shaping the illumination to optimize light field uniformity, and to further compensate for light collection of imaging optical elements, which may be employed in the apparatus as described hereinafter.

With regard to the aforementioned temporal [time] approach to assist in the formation of a resulting fused image channel, the temporal approach includes the coordination of multiple images in a synchronous or predetermined pattern, and the allocation and phasing of data acquisition periods so as to isolate different imaging modes from substantial spectral overlap, and destructive interference, in a manner not possible heretofore. The temporal approach also includes a synchronized, phase adjusted, and pulsed (strobed) illumination, which is effective to isolate different imaging modes, again, from spectral overlap, and destructive interference. The present invention is operable to form real-time, multi-dimensional images from detection sources, which include different modes of sensing, and contrast generation, such that the resulting images include feature-rich contrasts and are not limited to red, green or blue and similar color spaces. Further, the present invention is not limited primarily to represent three dimensional spatial dimensions. Rather, the present invention fuses or joins together image data from multiple sources to generate high-order, multi-dimensional contrast features representative of the objects being inspected so as to better identify desired features, and constituents of the objects within the image, and which can be utilized for more effective sorting of the stream of objects. The present invention as described, hereinafter, includes line scan or laser detectors, which correlate and fuse multiple channels of data having feature-rich object contrasts from streaming image data in real-time. This is in contrast to the more traditional approach of using two dimensional or area-array images, with or without lasers, as the basis for the formation of enhanced, three dimensional spatial or topographic images of individual objects moving within a stream of objects to be sorted.

Most importantly, the present invention, as described hereinafter, includes temporal [time] synchronization in combination with phase controlled, detector or interrogator isolation. This may be done in selective and variable combinations. While the present invention supports and allows for the use of more common devices such as optical beams splitters; spectra or dichroic filters; and polarization elements to isolate and combine the outputs of different detectors or interrogators, the present invention, in contrast, provides an effective means for separating and/or selectively and constructively combining image data from detection or interrogation sources that would otherwise destructively interfere with each other. As indicated earlier, while prior art methods are in existence, which employ beam splitters, dichroic spectral filters, and/or polarizing elements in various ways, these devices, and the associated methodology associated with their utilization, both individually, and in combination with each other, have many undesirable effects and limitations including, but not limited to, a lack of isolation of signals of different modes, but similar optical spectrum; unwanted change in a response per optical angle of incidence, and field angles; and/or a severe loss of sensitivity or affected dynamic range.

The apparatus and method of the present invention is generally indicated by the numeral 10 in FIG. 1A, and following. Referring now to FIG. 1A, the apparatus and method 10 of the present invention includes a camera 11 of traditional design. The camera has an optical axis which is generally indicated by the numeral 12. The optical axis, receives reflected electromagnetic radiation 13. Upon receiving the reflected electromagnetic radiation 13, which may be visible or invisible, the camera 11 produces a device signal 14, which is subsequently provided to an image pre-processor, which will be discussed in greater detail, below. In the arrangement as seen in FIG. 1A, a mirror 15 is provided, and which is utilized to direct or reflect electromagnetic radiation 13 along the optical axis 12 of the camera 11, so that the camera can form an appropriate device signal representative of the electromagnetic radiation, which has been collected.

Figure 1B:
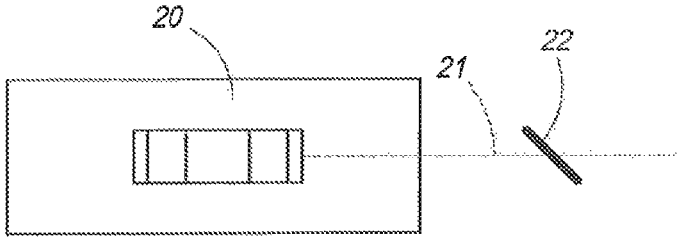
FIG. 1B is a greatly simplified, schematic view of a laser scanner, and a dichroic beam mixing optical element.

Referring now to FIG. 1B, the present apparatus and method 10 includes, in some forms of the invention, a laser or line scanner of traditional design, and which is generally indicated by the numeral 20. The laser scanner has an optical axis which is indicated by the numeral 21. Still further, and in one possible form of the invention, a dichroic beam mixing optical element 22 of traditional design is provided, and which is operable to act upon the reflective electromagnetic radiation 13, as will be described hereinafter so as to provide reflected electromagnetic radiation 13, which is then directed along the optical axis 12 of the camera 11.

Figure 1C:
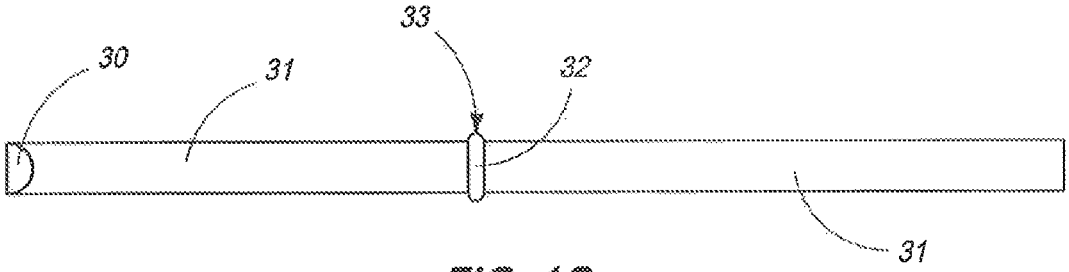
FIG. 1C is a greatly simplified, schematic representation of an illumination device emitting a beam of visible or invisible electromagnetic radiation, and wherein a detector focal plane is graphically depicted in spaced relation relative to the illumination device and along the emitted beam.
Figure 1D:
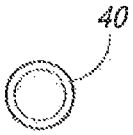
FIG. 1D is a greatly simplified depiction of a background element which as illustrated in the drawings, hereinafter, can be either passive, that is, no electromagnetic radiation is emitted by the background; or active, that is, the background can emit electromagnetic radiation, which is visible, or invisible.

Referring now to FIG. 1C, the present apparatus and method 10 includes a multiplicity of illumination devices which are generally indicated by the numeral 30. In this quite simplistic view, the respective illumination devices 30, when energized during predetermined time intervals, each produce a beam of electromagnetic radiation 31 [which may be collimated or uncollimated] and which is directed towards a location of a detector and/or interrogator focal plane, and which is generally indicated by the numeral 32. The location of the detector or interrogator focal plane 32 represents an orientation or location where a stream of objects to be inspected passes therethrough. The focal plane is located within an inspection station 33, as will be discussed in further detail, below. In the drawings, as provided, it will be recognized that the present apparatus and method 10 includes a background, which is generally, and simply illustrated by the numeral 40 in FIG. 1D. The background is well known. The background is located along the optical axis of the camera 11, and the laser scanner 20. The background, which is provided, can be passive, that is, the background emits no electromagnetic radiation, which is visible or invisible, or, on the other hand, it may be active, that is, it may be selectively energized to emit electromagnetic radiation, which may be either visible or invisible, depending upon the sorting application being employed.

Referring now to FIG. 1E a first form of the invention 41 is illustrated. In its most simplistic form, the invention 10 includes a camera 11, and a laser scanner 20, which are positioned on one side of an inspection station 33. Illumination devices 30 are provided, and which are also located on one side of the inspection station. As illustrated, the background 40 is located on the opposite side of the inspection station 33. Light (electromagnetic radiation) which is generated by the illuminators 30, are directed toward the focal plane 32. Further, objects requiring inspection pass through the inspection station 33, and reflected electromagnetic radiation from the objects are received by the camera 11. Referring now to FIG. 1E1, a graphical depiction of the first form of the invention 41 is illustrated. As will be appreciated, the methodology includes a step of energizing the camera 11 during two discrete time intervals, which are both before, and after, the laser scanner 20 is rendered operable. This temporal activity of the camera and laser scanner 20 prevents any destructive interference of the devices 11, and 20, one with the other.

Figure 2:
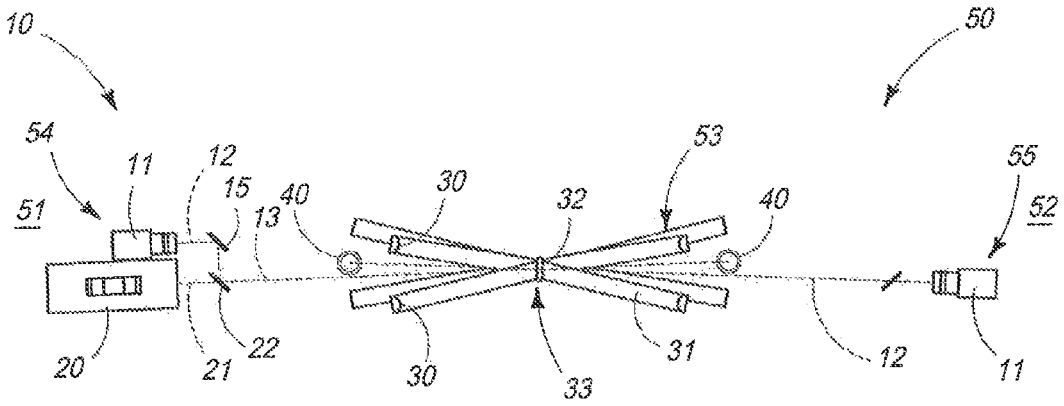
FIG. 2 is a greatly simplified, side elevation view of a second form of the present invention.
Figure 2A:
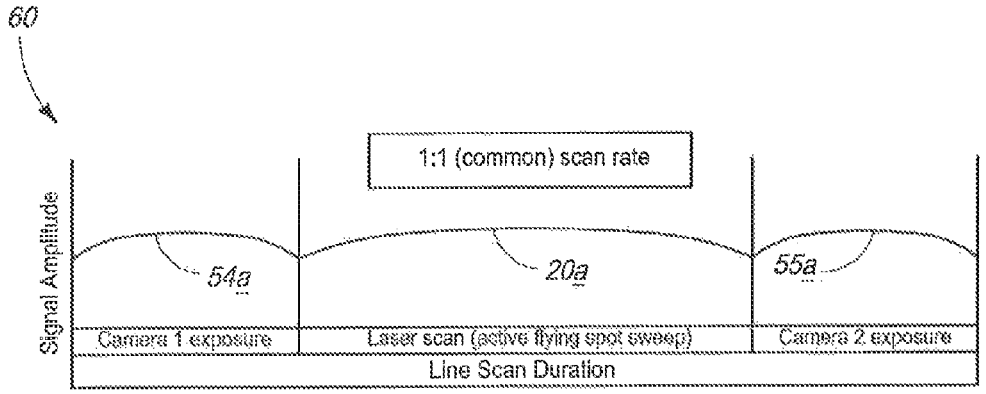
FIG. 2A is a greatly simplified, graphical depiction of the second form of the invention during operation.
Figure 2B:
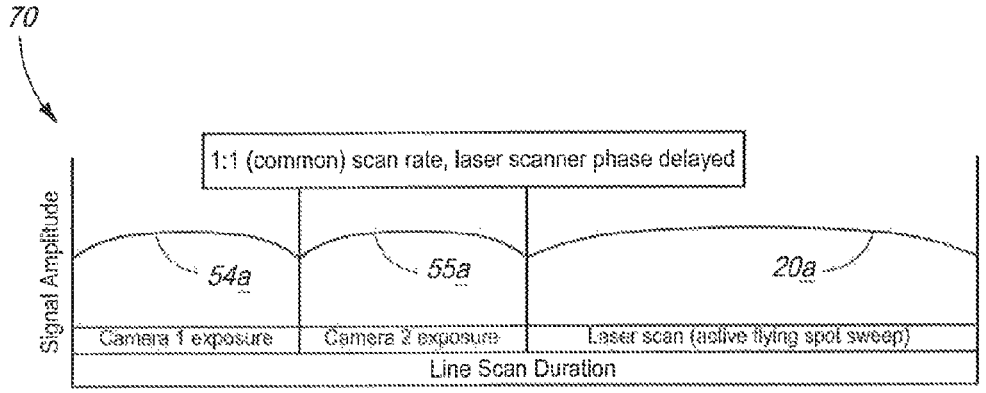
FIG. 2B is a greatly simplified, graphical depiction of a second mode of operation of the second form of the invention.

Referring now to FIG. 2, the second form of the invention 50 is shown, and which is operable to interrogate a stream of products, as will be discussed, below. It should be understood that the earlier-mentioned inspection station 33, through which a stream of products pass to be inspected, or interrogated, has opposite first and second sides 51 and 52, respectively, and which are spaced from the focal plane 32. In the second form of the invention 50, a multiplicity of illumination devices 53 are positioned on the opposite first and second sides 51 and 52 of the inspection station 33, and are oriented so as to generate beams of electromagnetic radiation 31, and which are directed at the focal plane 32, and through which the stream of the products pass for inspection. In the arrangement as seen in FIG. 2, the second form of the invention 10 includes a first camera detector 54, and a second camera detector 55, which are located on the opposite first and second sides 51 and 52 of the inspection station 33. As can be seen by an inspection of the drawings, the optical axis of the respective cameras 11, which are used in this form of the invention, are directed to the focal plane 32, and through which the objects to be inspected pass, and further extends to the background 40. Referring now to FIG. 2A, a first mode of operation 60 of the invention arrangement, is illustrated. In this graphical depiction, the temporal actuation of the respective cameras 54 and 55, respectively, as depicted in FIG. 2, is shown. The respective camera energizing or exposure time is plotted as against signal amplitude as compared with the laser scanner earlier mentioned, and which is indicated by the numeral 20. As can be seen, the camera actuation or exposure time is selected so as to achieve a one-to-one (1:1) common scan rate with the laser scanner 20. As will be recognized, the exposure time for cameras 1 and 2 (54 and 55) equals the active time period during which the laser scanner 20 is operational. As will be recognized, the signal amplitude of the first camera is indicated by the numeral 54(A). The signal amplitude of the laser scanner 20 is indicated by the numeral 20(A) and the signal amplitude of the second camera 55 is indicated by the numeral 55(A). Referring again to FIG. 2, and as a second possible mode of operation for the form of the invention, as seen in FIG. 2, an alternative arrangement for the actuation or exposure of the cameras 54 and 55 are provided relative to the duration and/or operation of the laser scanner 20. Again, the duration of the respective exposures of the cameras 54 and 55 is equal to the duration of the active laser scanner 20 operation as provided. In the arrangement as seen in FIG. 2B, it will be recognized that in the second mode of operation 70, the laser scanner 20, is actuated in a phase-delayed mode; however, in the mode of operation 70 as graphically depicted, a 1:1, a common scan rate is achieved.

Figure 3:
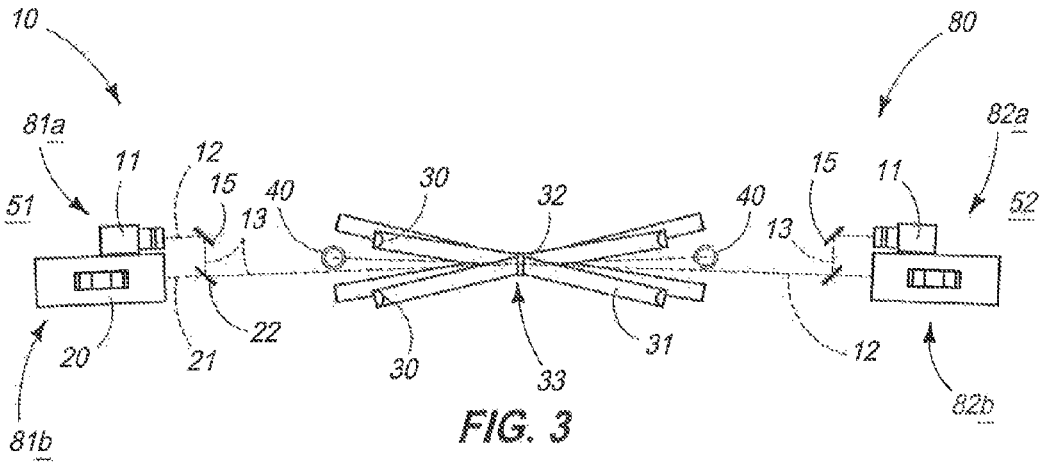
FIG. 3 is a greatly simplified, graphical depiction of a third form of the present invention.
Figure 3A:
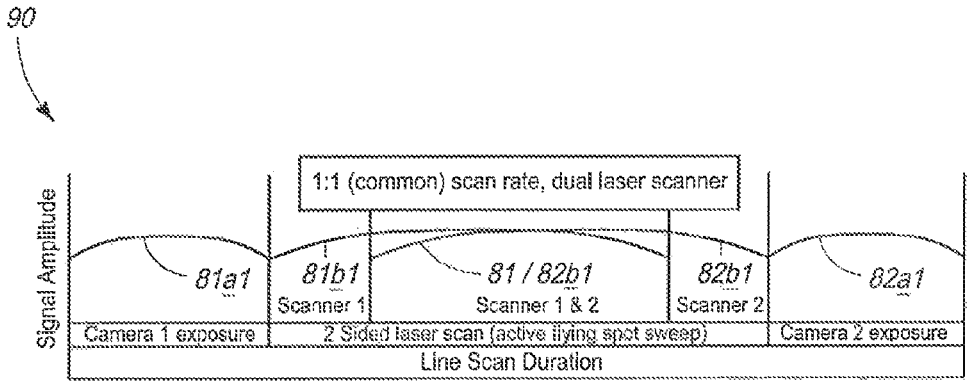
FIG. 3A is a greatly simplified, graphical depiction of the operation of the third form of the invention as depicted in FIG. 3.
Figure 3B:
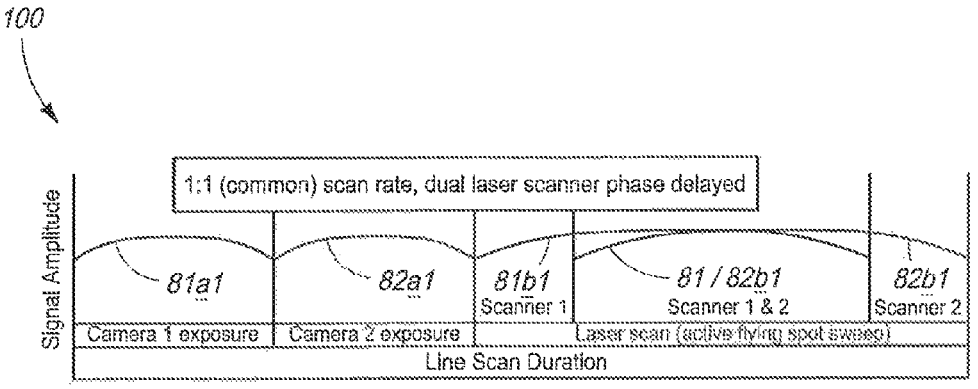
FIG. 3B is a greatly simplified, graphical depiction of the operation of the present invention as shown in FIG. 3 during a second mode of operation.

Turning now to FIG. 3, a third form of the invention 80 is illustrated in a quite simplistic form. The third form of the invention 80 includes a first camera and laser scanner combination indicated by the numerals 81A and 81B respectively, and which are positioned at the first side 51, of the inspection station 33. Still further, the third form of the invention includes a second camera and laser scanner combination 82A and 82B, respectively. Again, in the third form of the invention 80, multiple illumination devices 30 are provided, and which are selectively, electrically actuated so as to produce beams of electromagnetic radiation 31, which are directed towards the focal plane 32. Referring now to FIG. 3A, a first mode of operation 90, for the form of the invention 80, as seen in FIG. 3, is graphically depicted. It will be recognized that the combinations of the first and second cameras 81(*a*) and 82(*a*), along with laser scanners 81(*b*) and 82(*b*) as provided, provide a 1:1 scan rate. Again, when studying FIG. 3A, it will be recognized that the actuation or exposure of the respective cameras 81A and 82A, respectively, is equal to the time duration that the laser scanners 81B and 82B respectively, are operational. The signal amplitude of the first camera is indicated by the numeral 81A(1), and the signal amplitude of the laser scanner 81B is indicated by the numeral 81B(1). Still further, the signal amplitude of the second camera 82A is indicated by the numeral 82A(1), and the signal duration of the second laser scanner is indicated by the numeral 82B(1). Another alternative mode of operation is indicated by the numeral 100 in FIG. 3B. However in this arrangement, while a 1:1 common scan rate is achieved, the dual laser scanners 81B and 82B, respectively, are phase delayed.

Figure 4:
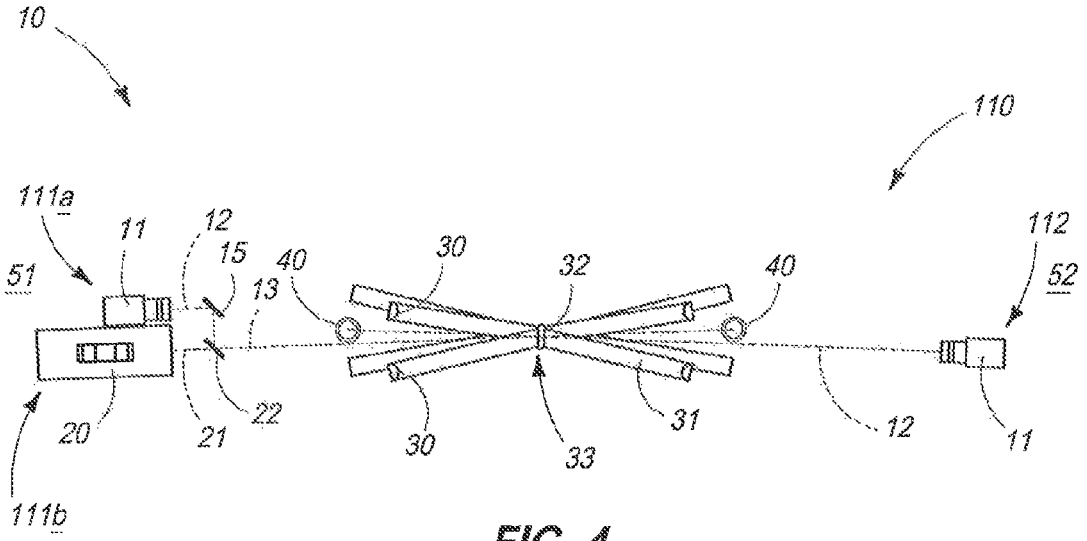
FIG. 4 is still another, greatly simplified, side elevation view of yet another form of the present invention.
Figure 4A:
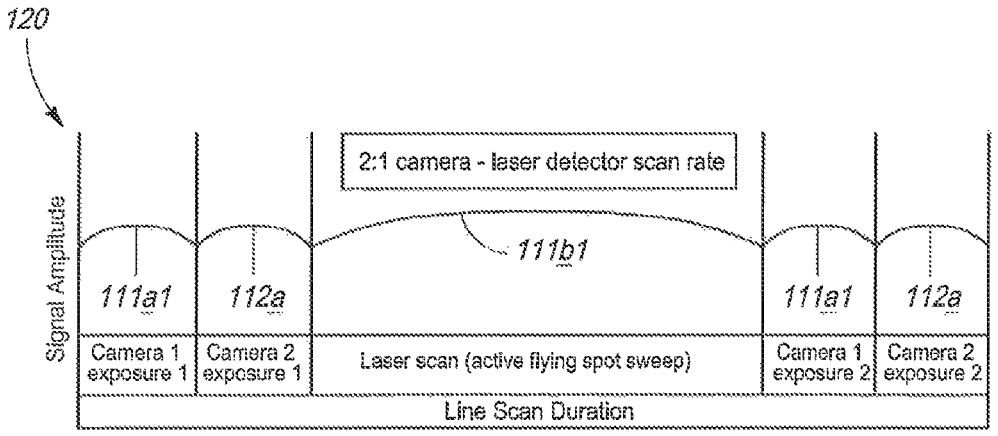
FIG. 4A is a greatly simplified, graphical depiction of the operation of the invention as seen in FIG. 4.

Referring now to FIG. 4, a fourth form of the invention is generally indicated by the numeral 110. In the arrangement, as seen in FIG. 4, a first camera and laser scanner combination are generally indicated by the numerals 111A and 111B, respectively, are provided, and which are positioned on one of the opposite sides 51 and/or 52 of the inspection station 33. In this arrangement a second camera 112 is positioned on the opposite side of the inspection station. In the mode of operation as best seen in the graphical depiction as illustrated in FIG. 4A, a 2:1 camera-laser scanner detection scan rate is achieved. The signal amplitude of the first camera 111A is indicated by the numeral 111A(1), and the signal amplitude of the laser scanner 111E is indicated by the numeral 111B(1). Still further, the signal amplitude of the second camera 112 is illustrated in FIG. 4A, and is indicated by the numeral 112A. Again, by a study of FIG. 4A, it will be recognized that the respective cameras and laser scanners, which are provided, can be selectively actuated during predetermined time periods to achieve the benefits of the present invention, which include, but are not limited to, preventing destructive interference of the respective scanners or cameras when viewing or interrogating a stream of objects passing through the inspection station 33, as will be described, below.

Figure 5:
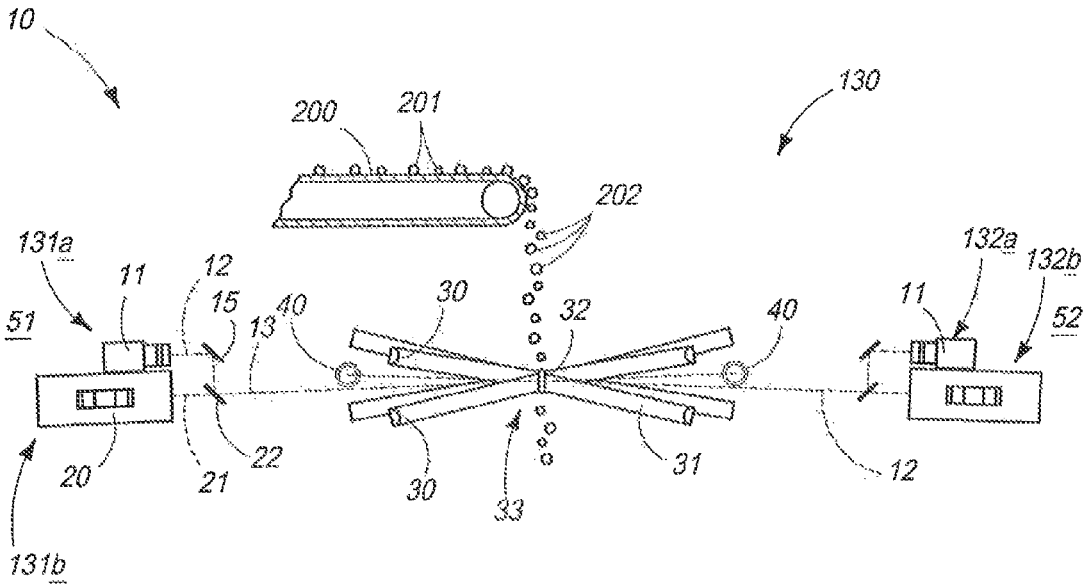
FIG. 5 is a greatly simplified, side elevation view of yet another form of the present invention.
Figure 5A:
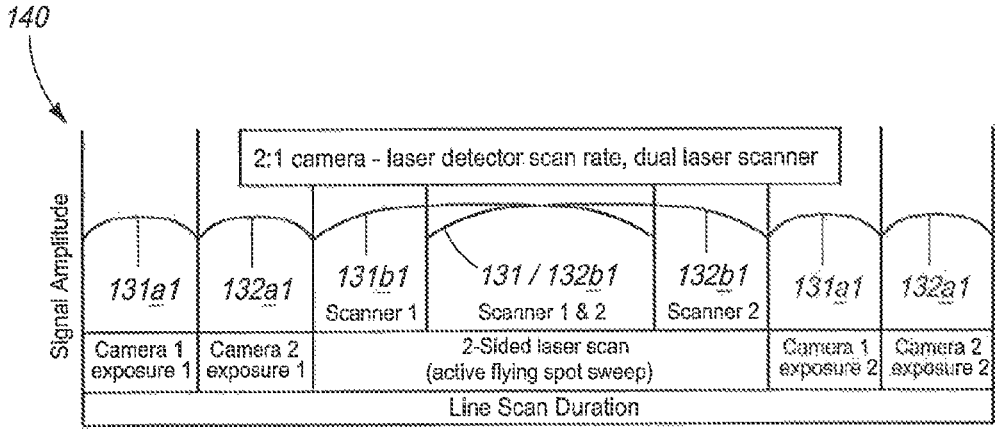
FIG. 5A is a greatly simplified, graphical depiction of the operation of the form of the invention as seen in FIG. 5.

Referring now to FIG. 5, a fifth form of the invention is generally indicated by the numeral 130. In this arrangement, which implements the methodology of the present invention, a first camera and laser scanner combination, are indicated by the numerals 131A and 131B, respectively, are provided. The first camera and line or laser scanner combination 131A and 131B are located on one side of the inspection station 33. Still further in this form of the invention 130, a second camera and laser scanner combination is indicated by the numerals 132A and 132B, respectively. The second camera and laser scanner combination is located on the opposite side of the inspection station 33. During one possible mode of operation of the invention, which is seen in FIG. 5A, and which is indicated by the numeral 140, the signal amplitude of the respective first and second camera and laser scanner combination, as described above, is shown. In the mode of operation 140 as depicted, a 2:1 camera-laser detection scan rate is achieved, utilizing this dual camera, dual laser scanner arrangement. Again by studying. FIG. 5A, it can be seen that the individual cameras and laser scanners, as provided, can be selectively, electrically energized so as to provide a data stream such that the individual detectors/interrogators/cameras, as provided, do not interfere with the operation of other detectors/cameras which are rendered operational while the product stream is passing through the inspection station 33.

Figure 6:
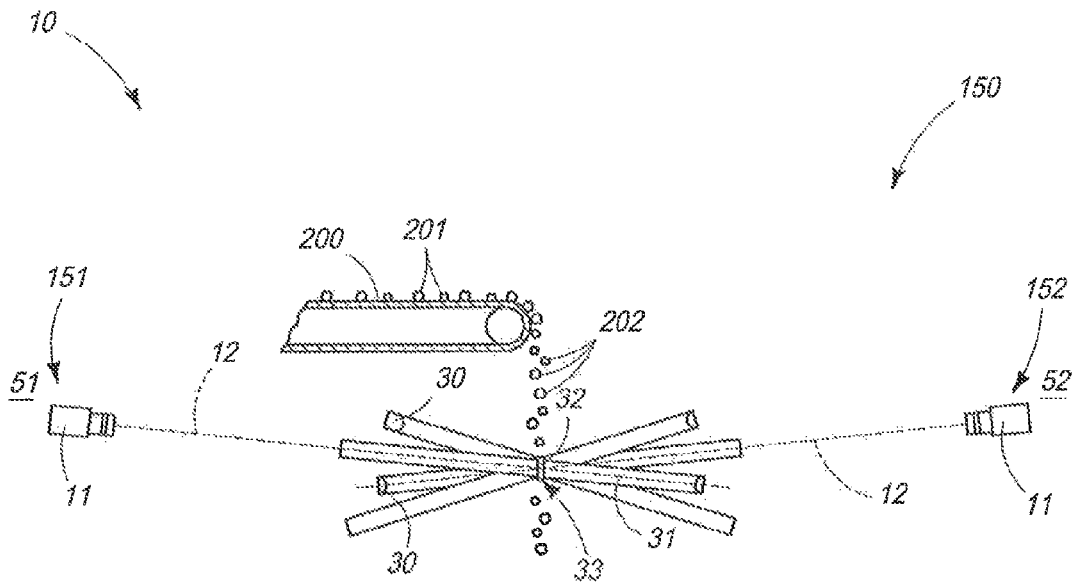
FIG. 6 is a greatly simplified, side elevation view of yet another form of the present invention.
Figure 6A:
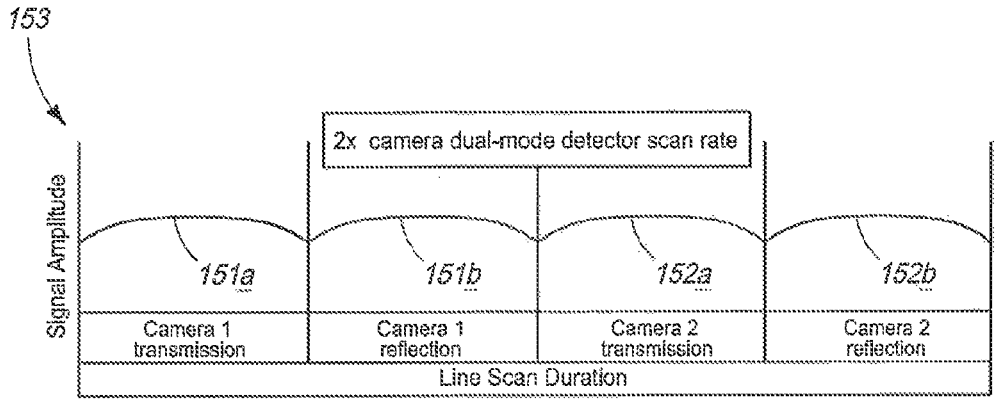
FIG. 6A is a greatly simplified, graphical depiction of the operation of the present invention as seen in FIG. 6.

Referring now to the sixth form of the invention, as seen in FIG. 6, the sixth form of the invention 150 includes first and second cameras, which are indicated by the numerals 151 and 152, respectively, and which are positioned on opposite sides of the inspection station 33. The respective cameras 151 and 152 have two modes of operation, that being a transmission mode, and a reflective mode. As seen in FIG. 6A, the mode of operation of the sixth form of the invention 150 is graphically illustrated. In this form of the invention the two cameras 151 and 152 are operated in a dual-mode detector scan rate. It will be noted that the duration of the camera actuation for transmission and reflection is substantially equal in time. The signal amplitude of the first camera transmission mode is indicated by the line labeled 151A, and the signal amplitude of the first camera reflection mode is indicated by the numeral 151B. Similarly, the signal amplitude of the second camera transmission mode is indicated by the numeral 152A, and the signal amplitude of the second camera reflection mode is indicated by the numeral 152B. Again, the respective cameras, as disclosed in this paragraph, are operated in a timely manner so as to prevent interference with other detectors and operations taking place, simultaneously.

Figure 7:
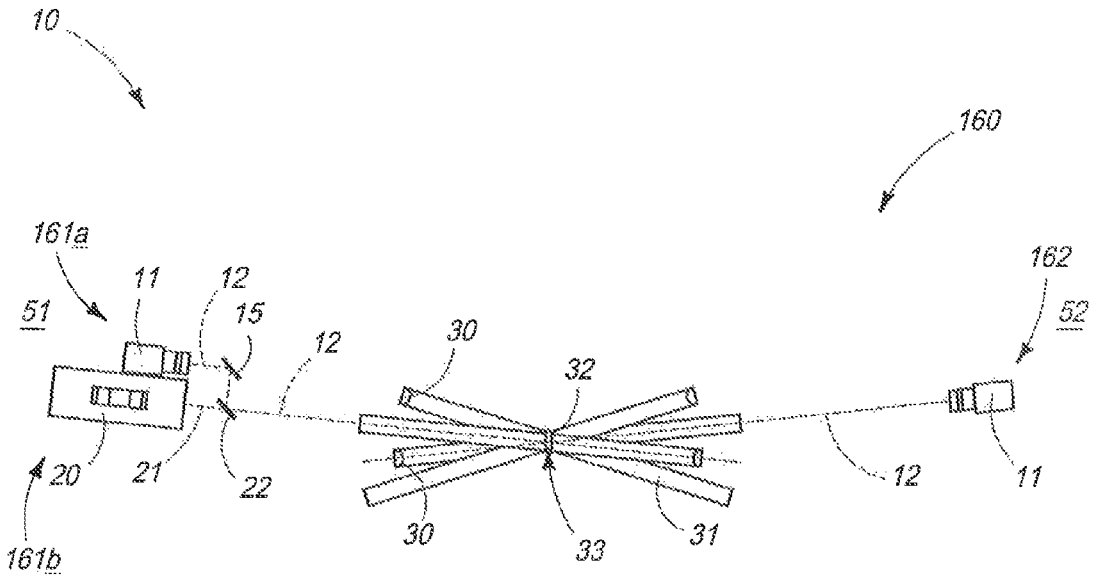
FIG. 7 is a greatly simplified, side elevation view of yet another form of the present invention.
Figure 7A:
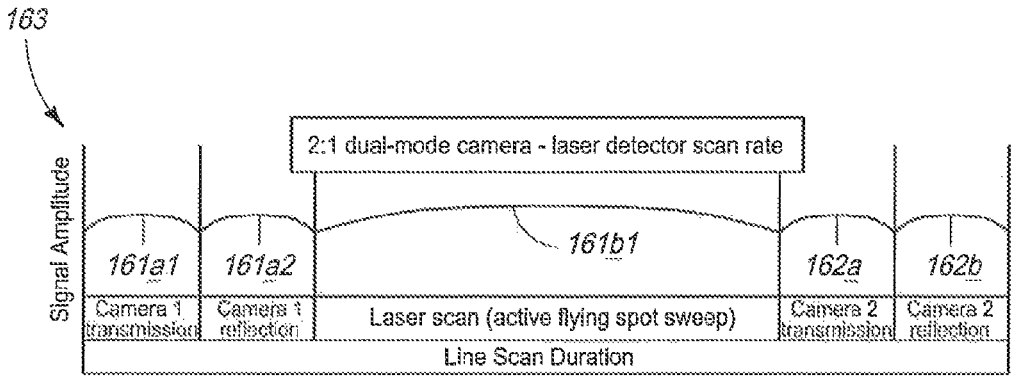
FIG. 7A is a greatly simplified, graphical depiction of the operation of the present invention as seen in FIG. 7.

Referring now to FIG. 7, a seventh form of the invention is generally indicated by the numeral 160 therein. In this greatly simplified form of the invention, a first camera, and first laser scanner combination 161A and 161B are provided, and which are positioned on one side of the inspection station 33. On the opposite side thereof, a second camera 162 is provided. Referring now to FIG. 7A, and in one mode of operation 163 of the arrangement as seen in FIG. 7, the mode of operation 163 is graphically depicted as a 2:1 dual-mode camera and laser scanner arrangement. As seen in FIG. 7A, the respective cameras 161A and 162, respectively, can be operated in either a transmission or reflection mode. As will be recognized by a study of FIG. 7A, the signal amplitude of the first camera 161(*a*) in the transmission mode, is indicated by the numeral 161A(1), and the signal amplitude of the reflective mode of the first camera is indicated by the numeral 161A(2). Further, the signal amplitude of the first laser scanner 161B, is indicated by the numeral 161B(1); and the signal amplitude of the transmission mode of the second camera is indicated by the numeral 162A. The signal amplitude of the reflective mode of the second camera is indicated by the numeral 162B. Again, the advantages of the present invention 10 relates to the selective actuation of the respective components, as described herein, so as to prevent destructive interference while the specific sensors/interrogators are rendered operable to inspect or interrogate a stream of products passing through the inspection station 33.

Figure 8:
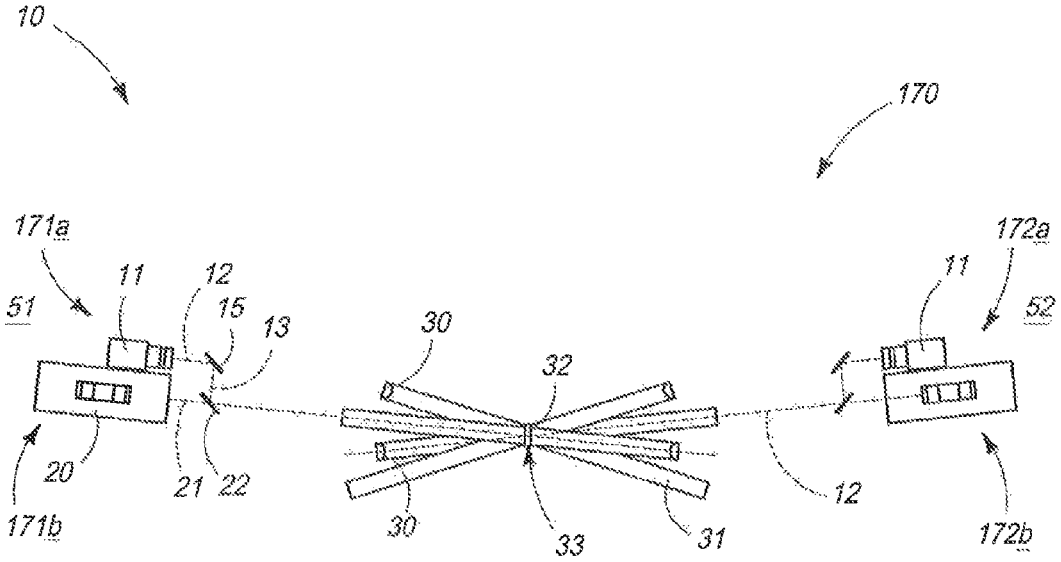
FIG. 8 is a greatly simplified, side elevation view of yet another form of the present invention.
Figure 8A:
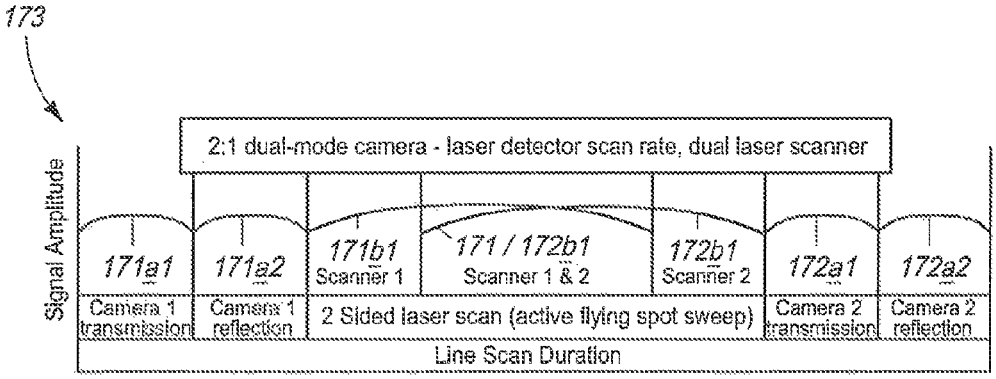
FIG. 8A is a greatly simplified, graphical depiction of the present invention as seen in FIG. 8 during operation.

Referring now to FIG. 8, an eighth form of the invention is generally indicated by the numeral 170. The eighth form of the invention includes, as a first matter, a first camera 171A, and first laser scanner 171B, which are each positioned in combination, and on one side of the inspection station 33. Further, a second camera and second laser scanner combination 172A and 172B, respectively, are located on the opposite side of the inspection station 33. As seen in FIG. 8A, a mode of operation is graphically depicted for the eighth form of the invention 170. As seen in that graphic depiction, a 2:1 dual mode camera-laser detector scan rate, and dual laser scanner operation can be conducted. As with the other for s of the invention, as previously illustrated, and discussed, above, the first camera 171A, and second camera 172A, each have a transmission and reflection mode of operation. Consequently, when studying FIG. 8A, it will be appreciated that the line labeled 171A(1) represents the signal amplitude of the first camera transmission mode, and the line labeled 171A(2) is the first camera reflection mode. Similarly, the signal amplitude of the second camera transmission mode is indicated by the line labeled 172A(1), and the second camera reflection mode is indicated by the line labeled 172A(2). The signal amplitude, over time, of the respective components, and in particular the first and second laser scanners, are indicated by the numerals 171B(1) and 172B(1), respectively.

Figure 9:
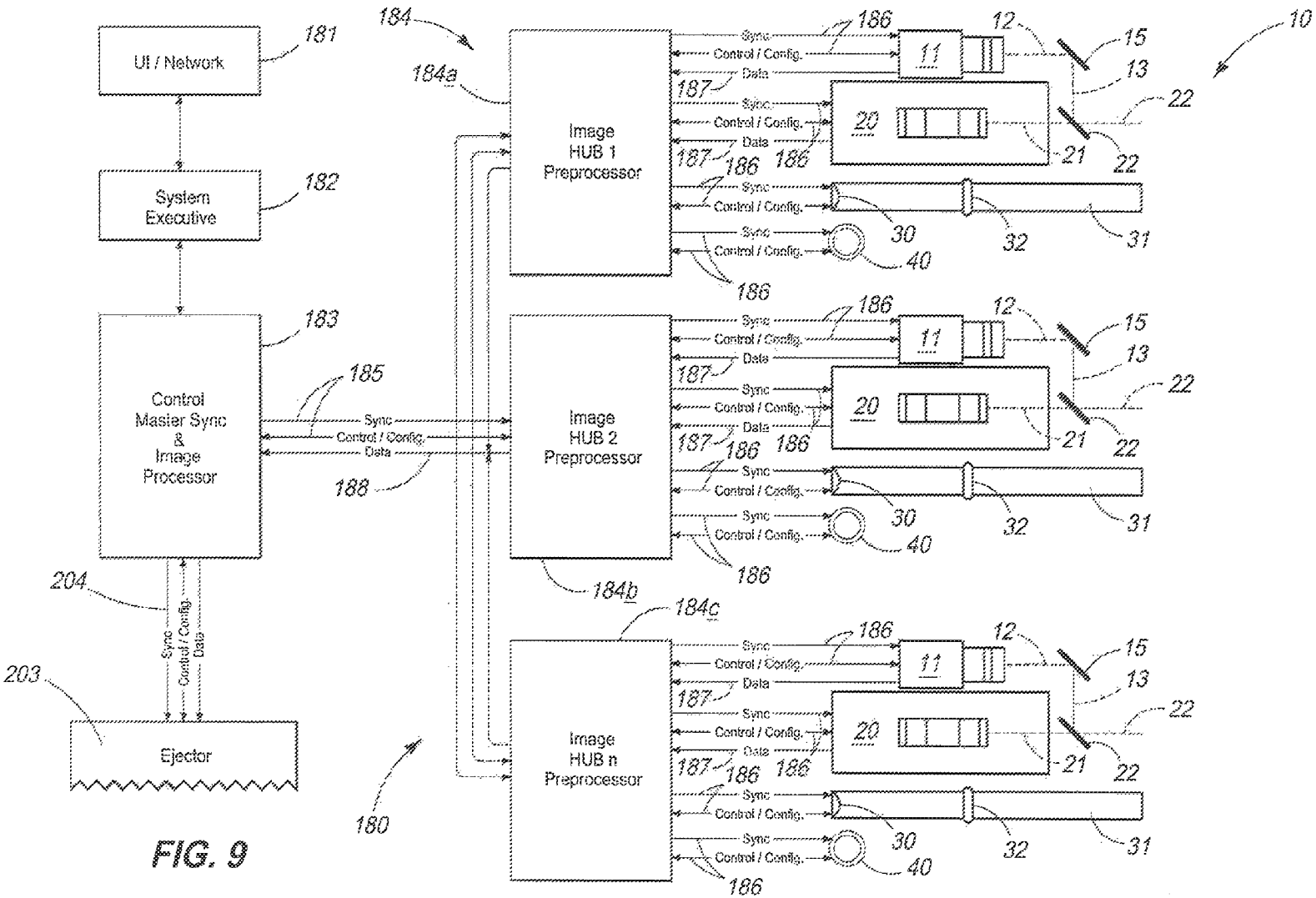
FIG. 9 is a greatly simplified, schematic diagram showing the major components, and working relationship of the components of the present invention which implement the methodology as described, hereinafter.

Referring now to FIG. 9, a greatly simplified schematic view is provided, and which shows the operable configuration of the major components of the present apparatus, and which is employed to implement the methodology of the present invention 10. With regard to FIG. 9, it will be recognized that the apparatus and methodology 10 includes a user interface or network input device, which is coupled to the apparatus 10, and which is used to monitor operations and make adjustments in the steps of the methodology, as will be described, below. The control arrangement, as seen in FIG. 9, and which is indicated by the numeral 180, includes the user interface 181, and which provides control and configuration data information, and commands to the apparatus 10, and the methodology implemented by the apparatus. The user interface is directly, electrically coupled either by electrical conduit, or by wireless signal to a system executive, which is a hardware and software device, which is used to execute commands provided by the user interface. The system executive provides controlling and configuration information, and a data stream, and further is operable to receive images processed by a downstream image processor, and master synchronous controller which is generally indicated by the numeral 183. As should be understood, the "System Executive" hosts the user interface, and also directs the overall, but not real-time, operation of the apparatus 10. The System Executive stores assorted, predetermined, executable programs which cause the selective activation of the various components which have been earlier described. The controller 183 is operable to provide timed, synchronous signals or commands in order to actuate the respective cameras 11, laser scanners 20, illumination assemblies 30, and backgrounds 40 as earlier described, in a predetermined order, and over given time periods so as to effect the generation of device signals, as will be discussed below, and which can then be combined and manipulated by multiple image preprocessors 184, in order to provide real-time data, which can be assembled into a useful data stream, and which further can provide real time information regarding the features and characteristics of the stream of products moving through the inspection station 33. As indicated above, the present control arrangement 180 includes multiple image preprocessors here indicated by the numerals 184A, 184B and 184C, respectively. As seen in FIG. 9, the command and control, and synchronous control information is provided by the controller 183, and is supplied to each of the image preprocessors 184A. B and C, respectively. Further it will be recognized that the image preprocessors 184A, B and C then provide a stream of synchronous control, and control and configuration data commands to the respective assemblies, such as the camera 11, laser scanner 20, illumination device 30, or background 40, as individually arranged, in various angular, and spatial orientations on opposite sides of the inspection station 30. This synchronous, and control and configuration data allows the respective devices, as each is described, above, to be switched to different modes; to be energized and de-energized in different time sequences; and further to be utilized in such a fashion so as to prevent any destructive interference from occurring with other devices, such as cameras 11, laser scanners 20 and other illumination devices 30, which are employed in the present invention 10. When rendered operational, the various electrical devices, and sensors which include cameras 11; laser scanners 20; illumination devices 30; and backgrounds 40, provide device signals 187, which are delivered to the individual image preprocessors 184A, B and C, and where the image pre-processors are subsequently operable to conduct operations on the supplied data in order to generate a resulting data stream 188, which is provided from the respective image pre-processors to the controller and image processor 183. The image processor and controller 183 is then operable to effect a decision making process in order to identify defective or other particular features of individual products passing through the inspection station 33, and which could be either removed by an ejection assembly, as noted below, or further diverted or processed in a manner appropriate for the feature identified.

As seen in the drawings, the current apparatus and method 10 includes, in one possible form, a conveyor 200 for moving individual products 201 in a nominally continuous bulk particular stream 202, along a given path of travel, and through one or more automated inspection stations 30, and one or more automated ejection stations 203. As seen in FIG. 9, the ejection station is coupled in signal receiving relation 204 relative to the controller 183. The ejection station is equipped with an air ejector of traditional design, and which removes predetermined products from a product stream through the release of pressurized air.

A sorting apparatus 10 for implementing the steps, which form the methodology of the present invention, are seen in FIG. 1A and following. In this regard, the sorting apparatus and method 10, of the present invention, includes a source of individual products 201, and which have multiple distinguishing features. Some of these features may not be easily discerned visually, in real-time in a fast moving product stream. The sorting apparatus 10 further includes a conveyor 200 for moving the individual products 201, in a nominally continuous bulk particulate stream 202, and along a given path of travel, and through one or more automated inspection stations 33, and one or more automated ejection stations 203. The sorting apparatus 10 further includes a plurality of selectively energizable illumination devices 30, and which are located in different spaced, angular orientations in the inspection station 33, and which, when energized, emit electromagnetic radiation 31, which is directed toward the stream of individual products 202, such that the electromagnetic radiation 31 is reflected or transmitted by the individual products 201, as they pass through the inspection station 33. The apparatus 10 further includes a plurality of selectively operable detection devices 11, and 20, which are located in different, spaced, angular orientations in the inspection station 33. The detection devices provide multiple modes of non-contact, non-destructive interrogation of reflected or transmitted electromagnetic radiation 31, to identify distinguishing features of the respective products 201. Some of the multiple modes of non-contact, non-destructive product interrogation, if operated continuously, simultaneous and/or coincidently, would destructively interfere with other interrogation signals formed from the products 201, which are interrogated. The apparatus 10 further includes a configurable, programmable, multi-phased, synchronizing interrogation signal acquisition controller 183, and which further includes an interrogation signal data processor and which is operably coupled to the illumination and detection devices 11, 20 and 30, respectively, so as to selectively activate illuminators 30, and detectors 11 and 20, in a programmable, predetermined order which is specific to the products 201 which are being inspected. This avoids the possibility of a destructive simultaneous interrogation signal interference, and preserves spatially correlated, and pixilated, real-time, interrogation signal data from each actuated detector 11 and 20, and which is supplied to the controller 183, as the products 201 pass through the inspection station 33. In the arrangement as seen in the drawings, the integrated image data preprocessor 184 combines the respective device signals 187 through a sub-pixel level correction of spatially correlated image data from each actuated detector 11, 20 to form real-time, continuous, multi-modal, multi-dimensional digital images 188 representing the product flow 202, and in which multiple dimensions of the digital data, indicating distinguishing features of said products, is generated. The apparatus 10 also includes a configurable, programmable, real-time, multi-dimensional interrogation signal data processor 182, and which is operably coupled to the controller 183, and image pre-processor 184. This assembly identifies products 201, and product features from contrasts, gradients and pre-determined ranges, and patterns of values specific to the products 201 being interrogated, and which is generated from the pre-processed continuous interrogation data. Finally, the apparatus has one or more spatially and temporally targeted ejection devices 203, which are operably coupled to the controller 183 and processor 182 to selectively redirect selected products 201 within the stream of products 202, as they pass through an ejection station 203.

OPERATION

The operation of the described embodiments of the present invention are believed to be readily apparent and are briefly summarized at this point. In its broadest aspect, the methodology of the present invention includes the steps of providing a stream 202 of individual products 201 to be sorted, and wherein the individual products 201 have a multitude of characteristics. The methodology of the present invention includes a second step of moving the stream of individual products 201 through an inspection station 33. Still another step of the present invention includes providing a plurality of detection devices 11 and 20, respectively, in the inspection station for identifying the multitude of characteristics of the individual products. The respective detection devices, when actuated, generate device signals 187, and wherein at least some of the plurality of devices 11 and 20, if actuated, simultaneously, interfere in the operation of other actuated devices. The methodology includes another step of providing a controller 183 for selectively actuating the respective devices 11, 20 and 30, respectively, in a pre-determined order, and in real-time, so as to prevent interference in the operation of the selectively actuated devices. The methodology includes another step of delivering the device signals 187 which are generated by the respective detection devices, to the controller 183. In the methodology of the present invention, the method includes another step of forming a real-time multiple-aspect representation of the individual products 201, and which are passing through the inspection station 33, with the controller 183, by utilizing the respective device signals 187, and which are generated by the devices 11, 20 and 30, respectively. The multiple-aspect representation has a plurality of features formed from the characteristics detected by the respective detection devices 11, 20 and 30, respectively. The method includes still another step of sorting the individual products 201 based, at least in part, upon the multiple aspect representation formed by the controller, in real-time, as the individual products pass through the inspection station 33.

It should be understood that the multitude of characteristics of the individual products 201, in the product stream 202 are selected from the group comprising color; light polarization; fluorescence; surface texture; and translucence to name but a few. It should be understood that the step of moving the stream of products 201 through an inspection station 33 further comprises releasing the stream of products, in one form of the invention, for unsupported downwardly directed movement through the inspection station 33, and positioning the plurality of detection devices on opposite sides 51, and 52, of the unsupported stream of products 202. It is possible to also use the invention 10 to inspect products on a continuously moving conveyor belt 200, or on a downwardly declining chute (not shown). In the methodology as described above, the step of providing a plurality of devices 11, 20, 30 and 40, respectively, in the inspection station 33, further comprises actuating the respective devices, in real-time, so as to enhance the operation of the respective devices, which are actuated. Still further, the step of providing a plurality of devices 11, 20, 30 and 40, respectively, in the inspection station 33, further comprises selectively combining the respective device signals 187 of the individual devices to provide an increased contrast in the characteristics identified on the individual products 201, and which are passing through the inspection station 33. It should be understood that the step of generating a device signal 187 by the plurality of detection devices in the inspection station further includes identifying a gradient of the respective characteristics which are possessed by the individual products 201, which are passing through the inspection station 33.

In the methodology as described, above, the step of providing a plurality of devices further comprises providing a plurality of selectively energizable illuminators 30, which emit, when energized, electromagnetic radiation 31, which is directed towards, and reflected from, individual products 201, and which are passing through the inspection station 33. The methodology further includes a step of providing a plurality of selectively operable image capturing devices 11, and which are oriented so as to receive the reflected electromagnetic radiation 31, and which is reflected from the individual products 201, and which are passing through the inspection station 33. The present method also includes another step of controllably coupling the controller 183 to each of the selectively energizable illuminators 30, and the selectively operable image capturing devices 11. In the arrangement as provided, and as discussed above, the selectively operable image capturing devices are selected from the group comprising laser scanners; line scanners; and the image capturing devices which are oriented in different, perspectives, and orientations relative to the inspection station 33. The respective image capturing devices are oriented so as to provide device signals 187 to the controller 183, and which would permit the controller 183 to generate a multiple aspect representation of the individual products 201 passing through the inspection station 33, and which have increased individual feature discrimination.

As should be understood, the selectively energizable illuminators 30 emit electromagnetic radiation, which is selected from the group comprising visible; invisible; collimated; non-collimated; focused; non-focused; pulsed; non-pulsed; phase-synchronized; non-phase-synchronized; polarized; and non-polarized electromagnetic radiation.

In the methodology as described above, the method as discussed in the immediately preceding paragraphs includes a step of providing and electrically coupling an image pre-processor 184 with a controller 183. Before the step of delivering the device signals 187, which are generated by the respective detection devices 11, 20, 30 and 40 to the controller 183, the methodology includes a step of delivering the device signals 187 to the image preprocessor 184. Further, the step of delivering the device signal 187 to the image preprocessor further comprises, combining and correlating phase-specific and synchronized detection device signals 187, by way of a sub-pixel digital alignment in a scaling and a correction of generated device signals 187, which are received from the respective devices 11, 20, 30 and 40, respectively.

The method of sorting, of the present invention, includes, in one possible form, a step of providing a source of products 201 to be sorted, and secondly, providing a conveyor 200 for moving the source of products 202 along the path of travel, and then releasing the products 201 to be sorted into a product stream 202 for unsupported movement through a downstream inspection station 33. In this particular form of the invention, the methodology includes another step of providing a first, selectively energizable illuminator 30, which is positioned elevationally above, or to the side of the product stream 202, and which, when energized, illuminates the product stream 202 which is moving through the inspection station 33. The methodology includes another step of providing a first, selectively operable image capturing device 11, and which is operably associated with the first illuminator 30, and which is further positioned elevationally above, or to the side of the product stream 202, and which, when actuated, captures images of the illuminated product stream 202, moving through the inspection station 33. The method, as described herein, includes another step of providing a second selectively energizable illuminator 30, which is positioned elevationally below, or to the side of the product stream 202, and which, when energized, emits a narrow beam of light 31, which is scanned along a path of travel, and across the product stream 202, which is moving through the inspection station 33. The method includes yet another step of providing a second, selectively operable image capturing device, which is operably associated with the second illuminator 30, and which is further positioned elevationally above, or to the side of the product stream, and which, when actuated, captures images of the product stream 202, and which is illuminated by the narrow beam of light 31, and which is emitted by the second selectively energizable illuminator 30. The methodology includes another step of providing a third, selectively energizable illuminator 30, which is positioned elevationally below, or to the side of the product stream 202, and which, when energized, illuminates the product stream 202, and which is moving through the inspection station 33. In the methodology as described, the method includes another step of providing a third, selectively operable image capturing device 11, and which is operably associated with the second illuminator 30, and which is further positioned elevationally below, or to the side of the product stream 202, and which further, when actuated, captures images of the illuminated product stream 202, moving through the inspection of station 33; and generating with the first, second and third image capturing devices 11, an image signal 187, formed of the images generated by the first, second and third imaging capturing devices. The methodology includes another step of providing a controller 183, and electrically coupling the controller 183 in controlling relation relative to each of the first, second and third illuminators 30, and image capturing devices 11, respectively, and wherein the controller 183 is operable to individually and sequentially energize, and then render operable the respective first, second and third illuminators 30, and associated image capturing devices 11 in a predetermined pattern, so that only one illuminator 30, and the associated image capturing device 11, is energized or rendered operable during a given time period. The controller 183 further receives the respective image signals 187, which are generated by each of the first, second and third image capturing devices 11, and which depicts the product stream 202 passing through the inspection station 33, in real-time. The controller 183 analyzes the respective image signals 187 of the first, second and third image capturing devices 11, and identifies any unacceptable products 201 which are moving along in the product stream 202. The controller 183 generates a product ejection signal 204, which is supplied to an ejection station 203 (FIG. 9), and which is downstream of the inspection station 33.

In the method as described in the paragraph immediately above, the methodology includes another step of aligning the respective first and third illuminators 30, and associated image capturing devices 11, with each other, and locating the first and third illuminators 30 on opposite sides 51, and 52 of the product stream 202. In the methodology of the present invention, the predetermined pattern of energizing the respective illuminators 30, and forming an image signal 187, with the associated image capturing devices 11, further comprises the steps of first rendering operable the first illuminator 30, and associated image capturing device 11 for a first pre-determined period of time; second rendering operable the second illuminator, and associated image capturing device for a second predetermined period of time, and third rendering operable the third illuminator 30 and associated image capturing device 11 for a third pre-determined period of time. In this arrangement, the first, second and third predetermined time periods are sequential in time. In the arrangement as provided, the step of energizing the respective illuminators 30 in a pre-determined pattern and image capturing devices takes place in a time interval of about 50 microseconds to about 500 microseconds. As should be understood, the first predetermined time period is about 25 microseconds to about 250 microseconds; the second predetermined time period is about 25 microseconds to about 150 microseconds, and the third predetermined time period is about 25 microseconds to about 250 microseconds. In the methodology as described, the first and third illuminators comprise pulsed light emitting diodes; and the second illuminator comprises a laser scanner. Still further, it should be understood that the respective illuminators, when energized, emit electromagnetic radiation which lies in a range of about 400 nanometers to about 1,600 nanometers. It should be understood that the step of providing the conveyor 200 for moving the product 201 along a path of travel comprises providing a continuous belt conveyor, having an upper and a lower flight, and wherein the upper flight has a first intake end, and a second exhaust end, and positioning the first intake end elevationally above the second exhaust end. In the methodology of the prevent invention, the step of transporting the product with a conveyor 200 takes place at a predetermined speed of about 3 meters per second to about 5 meters per second. In one form of the invention, the product stream 202 moves along a predetermined trajectory, which is influenced, at least in part, by gravity, and which further acts upon the unsupported product stream 202. In at least one form of the present invention, the product ejection station 203 is positioned about 50 millimeters to about 150 millimeters downstream of the inspection station 33. As should be understood, the predetermined sequential time periods that are mentioned above, do not typically overlap.

The present invention discloses a method for sorting a product 10 which includes a first step of providing a source of a product 201 to be sorted; and a second step of transporting the source of the product along a predetermined path of travel, and releasing the source of product into a product stream 202 which moves in an unsupported gravity influenced free-fall trajectory along at least a portion of its path of travel. The method includes another step of providing an inspection station 33 which is located along the trajectory of the product stream 202; and a step of providing a first selectively energizable illuminator 30, and locating the first illuminator to a first side of the product stream 202, and in the inspection station 33. The methodology of the present invention includes another step of providing a first, selectively operable image capturing device 11, and locating the first image capturing device 11 adjacent to the first illuminator 30. The present methodology includes another step of energizing the first illuminator 30, and rendering the first image capturing device 11 operable, substantially simultaneously, for a first predetermined time period, so as to illuminate the product stream 202, moving through the inspection station 33, and subsequently generate an image signal 187, with the first image capturing device 11 of the illuminated product stream 202. The present methodology 10 includes another step of providing a second, selectively energizable illuminator 30, and locating the second illuminator on a first side of the product stream 202, and in spaced relation relative to the first illuminator 30. The method includes another step of providing a second, selectively operable image capturing device 11, and locating the second image capturing device adjacent to the second illuminator 30. The method includes another step of energizing the second illuminator 30 so as to generate a narrow beam of electromagnetic radiation or light 31, which is scanned across a path of travel which is transverse to the product stream 202, and which further is moving through the inspection station 33. The method, as described further, includes a step of rendering the second image capturing device operable substantially simultaneously, for a second predetermined time period, and which is subsequent to the first predetermined time period. The second illuminator 30 illuminates, with a narrow beam of electromagnetic radiation, the product stream 203, which is moving through the inspection station 33; and the second image capturing device subsequently generates an image signal 187 of the illuminated product stream 202. The method includes another step of providing a third, selectively energizable illuminator 30, which is positioned to the side of the product stream 202, and which, when energized, illuminates the product stream 202 moving through the inspection station 33. The method includes still another step of providing a third, selectively operable image capturing device 11, and locating the third image capturing device 11 adjacent to the third illuminator. In the methodology as described, another step includes energizing the third illuminator 30, and rendering the third image capturing device 11 simultaneously operable for a third predetermined time period, so as to illuminate the product stream 202 moving through the inspection station 30, while simultaneously forming an image signal 187 with a third image capturing device 11 of the illuminated product stream 202. In this arrangement, the third predetermined time period is subsequent to the first and second predetermined time periods. The method as described includes another step of providing a controller 183, and coupling the controller 183 in controlling relation relative to each of the first, second and third illuminators 30, and image capturing devices 11, respectively. The methodology includes another step of providing and electrically coupling an image preprocessor 184, with the controller 183, and supplying the image signals 187 which are formed by the respective first, second and third image capturing devices 11, to the image preprocessor 184. The methodology includes another step of processing the signal images 187, which are received by the image preprocessor 184, and supplying the image signals to the controller 183, so as to subsequently identify a defective product or a product having a predetermined feature, in the product stream 202, and which is passing through the inspection station 33. The controller 183 generates a product ejection signal when the defective product and/or product having a given feature, is identified. The method includes another step of providing a product ejector 203, which is located downstream of the inspection station 33, and along the trajectory or path of travel of the product stream 202, and wherein the controller 183 supplies the product ejection signal 204 to the product ejector 203 to effect the removal of the identified defective product or product having a predetermined feature from the product stream.

The present invention 10 can be further described according to the following methodology. A method for sorting products 10 is described, and which includes the steps of providing a nominally continuous stream of individual products 201 in a flow of bulk particulate, and in which individual products 201 have multiple distinguishing features, and where some of these features may not be easily discerned visually, in real-time. The methodology includes another step of distributing the stream of products 202, in a mono-layer of bulk particulate, and conveying or directing the products 201 through one or more automated inspection stations 33, and one or more automated ejection stations 203. The methodology includes another step of providing a plurality of illumination 30, and detection devices 11 and 20, respectively, in the inspection station 33, and wherein the illumination and detection devices use multiple modes of non-contact, non-destructive interrogation to identify distinguishing features of the products 201, and wherein some of the multiple modes of non-contact, non-destructive product interrogation, if operated continuously, simultaneously and/or coincidently, destructively interfere with at least some of the interrogation result signals 187, and which are generated for the respective products 201, and which are passing through the inspection station 33. The methodology includes another step of providing a configurable, programmable, multi-phased, synchronizing interrogation signal acquisition controller 183, and an integrated interrogation signal data pre-processor 184, which is operably coupled to the illumination and detection devices 30 and 11, respectively, to selectively activate the individual illuminators, and detectors in a programmable, pre-determined order specific to the individual products 201 being inspected to avoid any destructive, simultaneous, interrogation signal interference, and preserve spatially correlated and pixilated real-time interrogation signal image data 187, from each actuated detector 11 and 20, respectively, to the controller 183, as the products 201 pass through the inspection station 33. The methodology includes another step of providing sub-pixel level correction of spatially correlated, pixilated interrogation image data 187, from each actuated detector 11 and 20, respectively, to form real-time, continuous, multi-modal, multi-dimensional, digital images representing the product flow 202, and wherein the multiple dimensions of digital data 187 indicate distinguishing features of the individual products 201. The method includes another step of providing a configurable, programmable, real-time, multi-dimension interrogation signal data processor 182, which is operably coupled to the controller 183, and preprocessor 184, to identify products 201, and product features possessed by the individual products from contrast gradients and predetermined ranges, and patterns of values specific to the individual products 201, from the preprocessed continuous interrogation data 187. The method 10 includes another step of providing one or more spatially and temporally targeted ejection devices 203, which are operably coupled to the controller 183, and preprocessor 184, to selectively re-direct selected objects or products 201 within the stream of products 202, as they individually pass through the ejection station 203.

Referring now to FIG. 1E, the first embodiment of the invention 10 is depicted, and is illustrated in one form. While simple in its overall arrangement, this first embodiment supports scan rates between the camera 11, and the laser scanner 20, of 2:1, and wherein the camera 11 can run twice the scan rate of the laser scanner 20. This is a significant feature because laser scanners are scan-rate limited by inertial forces due to the size and mass of the associated polygonal mirror used to direct a flying scan spot formed of electromagnetic radiation, to the inspection station 33. On the other hand, the camera 11 has no moving parts, and are scan-rate limited solely by the speed of the electronics and the amount of exposure that can be generated per unit of time that they are energized or actuated.

Referring now to FIG. 2, a second embodiment of the invention is shown, and which adds a second, opposite side camera 55, which uses the time slot allotted to the first camera's second exposure. This arrangement as seen in FIG. 2, is limited to 1:1 scan rates.

Referring now to FIG. 3, the third embodiment of the invention adds a second laser scanner 20, which is phase-delayed from the first scanner, to avoid having their respective scanned spots formed of electromagnetic radiation from being in the same place at the same time. As should be understood, fully coincident laser scanner spots are one form of destructive interference, which the present invention avoids. This form of the invention is limited to 1:1 scan rates.

Referring now to FIG. 4, a fourth embodiment of the invention is shown and which divides the time slot allotted for each camera 111A and 11, respectively, when compared to the previous two embodiments, into two time slots, so that both cameras can run at twice the scan rate of the associated laser scanner 20. The associated detector hardware configuration is the same as the second form of the invention, but control and exposure timing are different, and can be selectively changed by way of software commands such that a user, not shown, can select sorting and actuation patterns that use one mode, or the other, as appropriate for a particular sorting application.

Referring now to FIG. 5, a fifth form of the invention is illustrated and wherein a second laser scanner 132B is provided, and which includes the scanning timing as seen in the fourth form of the invention. As noted above, the associated detector hardware configuration is the same as the third form of the invention, but control and exposure timing are different, and can be changed such that a user could select sorting steps that use only one mode or the other, as appropriate, for a particular sorting application.

Referring now to FIG. 6, the sixth form of the invention introduces a dual camera arrangement 151 and 152, respectively, and wherein the cameras view active backgrounds that are also foreground illumination for the opposite side camera. Each camera acquires both reflective and transmitted images which create another form of the multi-modal, multi-dimensional image. In this embodiment, each camera scans at twice the overall system scan rate, but image data 187 is all at the overall system scan rate, since half of each of the cameras exposure is for a different imaging mode prior to pixel data fusion, which then produces higher dimensional, multi-modal images at the system scan rate, which is provided.

Referring now to FIG. 7, this form of the invention adds a dual-mode reflection/transmission camera operation embodiment of the sixth form of the invention with a laser scanner 161B which is similar to the second and fourth embodiments. A difference in this arrangement is that either selectively active backgrounds are used in a detector arrangement as shown in FIG. 2 or 4, or cameras are aimed at opposite side illuminators, as seen in FIG. 7. Using the detector arrangement, as shown in the second form of the invention, provides more flexibility but requires more hardware.

Referring now to FIG. 8, this form of the invention adds a second laser scanner 172B to that seen in the seventh form of the invention, and further employs the time-phased approach as seen in the third and fifth forms of the invention. As should be understood, the present invention can be scaled to increase the number of detectors.

Therefore, it will be seen that the present invention provides a convenient means whereby the destructive interference that might result from the operation of multiple detectors and illuminators is substantially avoided, and simultaneously provides a means for collecting multiple levels of data, which can then be assembled, in real-time, to provide a means for providing intelligent sorting decisions in a manner not possible heretofore.

In compliance with the statute, the invention has been described in language more or less specific as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

The invention claimed is:

1. A method of sorting comprising:

providing a source of a product to be sorted, the product comprised of a plurality of individual items each having a multitude of characteristics, and wherein the multitude of characteristics range from color; light polarization; fluorescence; reflectance; scatter; transmittance; surface texture and translucence, and wherein the multitude of characteristics can be determined at least in part, from electromagnetic radiation which is spectrally reflected, or transmitted;

conveying the plurality of individual items along a path of travel, and then releasing the plurality of individual items into a product stream for unsupported movement through a downstream inspection station for selective illumination and contemporaneous imaging of each of the plurality of individual items;

selectively energizing a first illuminator which is positioned on a first side of the product stream, and which, when energized, illuminates a first side of each of the plurality of individual items in the product stream that are moving through the inspection station;

selectively operating a first image capturing device which is operably associated with the first illuminator, and which is further positioned on the first side of the product stream, and which, when actuated, captures images of the first side of each of the plurality of individual items illuminated by the energized first illuminator and moving through the inspection station, and which further generates a first interrogation signal;

selectively energizing a second illuminator which is positioned on the first side of the product stream, and which, when energized, emits a narrow beam of light which is scanned along a path of travel, and across the product stream moving through the inspection station;

selectively operating a second image capturing device which is operably associated with the second illuminator, and which is further positioned on the first side of the product stream, and which, when actuated, captures images of each of the plurality of individual items moving through the inspection station and illuminated by the narrow beam of light emitted by the energized second illuminator, and which further generates a second interrogation signal;

selectively energizing a third illuminator which is positioned on a second side of the product stream, and which, when energized, illuminates a second side of each of the plurality of individual items moving through the inspection station;

selectively operating a third image capturing device which is operably associated with the third illuminator, and which is further positioned on the second side of the product stream, and which, when actuated, captures images of the second side of each of the plurality of individual items moving through the inspection station and illuminated by the energized third illuminator, and which further generates a third interrogation signal;

selectively energizing a fourth illuminator which is positioned on the second side of the product stream, and which, when energized, emits a narrow beam of light which is scanned along a path of travel, and across the product stream moving through the inspection station;

selectively operating a fourth image capturing device which is operably associated with the fourth illuminator, and which is further positioned on the second side of the product stream, and which, when actuated, captures images of the second side of each of the plurality of individual items moving through the inspection station and illuminated by the narrow beam of light emitted by the energized fourth illuminator, and which further generates a fourth interrogation signal;

operatively coupling a controller in controlling relation relative to each of the first, second, third, and fourth selectively energizable illuminators, and selectively operable image capturing devices, respectively, and wherein the controller selectively and individually energizes the respective first, second, third, and fourth illuminators, and selectively and individually operates the associated image capturing devices, in a predetermined pattern, so that only an identified illuminator and associated image capturing device or a cooperating combination of illuminators, and associated image capturing devices are selectively energized or rendered operable, during a predetermined time period so as to isolate the interrogation signals derived from each of the selectively operable image capturing devices from spectral overlap and to further prevent destructive interference between the respective selectively energized illuminators, and selectively operated image capturing devices;

and wherein the controller further receives the respective interrogation signals generated by the respective first, second, third, and fourth image capturing devices, and wherein the controller analyzes the respective interrogation signals received from the respective first, second, third, and fourth image capturing devices and determines the multitude of characteristics with electromagnetic radiation that is spectrally reflected or transmitted, and the controller further identifies unacceptable individual items in the product stream, and generates a product ejection signal; and providing a product ejector downstream of the inspection station, and which receives the product ejection signal, and which ejects any of the plurality of individual items moving along the unsupported path of travel in the product stream that has been identified by the controller as unacceptable.

2. The method for sorting as claimed in claim 1, and further comprising the step:

aligning the respective first and second illuminators, and associated image capturing devices with each other to focus on a single focal plane, and locating the third and fourth illuminators, and associated image capturing devices, on the opposite side of the product stream and orienting the third and fourth illuminators and associated image capturing devices to focus on the single focal plane.

3. The method for sorting as claimed in claim 1, and further comprising the step:

aligning the respective second and fourth illuminators and associated image capturing devices with each other to focus on a single focal plane, and selectively operating the respective second and fourth illuminators, and associated image capturing devices, in a phase delayed operation on opposite sides of the product stream such that each illuminator does not destructively interfere with another image capturing device.

4. The method for sorting as claimed in claim 1, and wherein the predetermined pattern of energizing the respective first, second, third and fourth illuminators, and forming the interrogation signal with the associated image capturing devices further comprises first, energizing the first illuminator, and operating the associated image capturing device for a first predetermined period of time; second, energizing the second illuminator and operating the associated image capturing device for a second, predetermined time period; third, energizing the third illuminator, and operating the associated image capturing device for a third, predetermined time period; and fourth, energizing the fourth illuminator and operating the associated image capturing device for a fourth, predetermined time period that is phase delayed from, and partially overlapping with the second predetermined time period, and wherein the first, second and third predetermined time periods are sequential, in time, and the fourth predetermined time period partially overlaps, and extends from the second predetermined time period.

5. The method for sorting as claimed in claim 1, and wherein the step of energizing the respective illuminators in a predetermined pattern, and operating the image capturing devices in the predetermined pattern takes place in a time interval of about 50 microseconds to about 500 microseconds.

6. The method for sorting as claimed in claim 4, and wherein the first predetermined time period is about 25 microseconds to about 250 microseconds; and the second predetermined time period is about 75 microseconds to about 150 microseconds; and the third predetermined time period is about 25 microseconds to about 250 microseconds; and the fourth predetermined time period is about 75 microseconds to about 150 microseconds, and partially overlaps with the second predetermined time period and is further phase delayed by about 5 microseconds to about 25 microseconds and effectively extends from the second predetermined time period by about 5 microseconds to about 25 microseconds.

7. The method for sorting as claimed in claim 1, and wherein the first and third illuminators comprise pulsed light emitting diodes; and the second and fourth illuminators comprise laser scanners.

8. The method for sorting as claimed in claim 1, and wherein the respective illuminators, when energized, emit electromagnetic radiation which lies in a range of about 400 nanometers to about 1600 nanometers wavelength.

9. The method for sorting as claimed in claim 1, and wherein the step of conveying the product along a path of travel comprises providing a continuous belt conveyor having an upper and lower flight; and wherein the upper flight has a first intake end, and a second exhaust end; and positioning the first, intake end elevationally, above, the second, exhaust end.

10. The method for sorting as claimed in claim 9, and further comprising conveying the product with the conveyor at a predetermined speed of about 3 meters per second to about 5 meters per second.

11. The method for sorting as claimed in claim 1, and wherein the product stream moves along a predetermined trajectory which is influenced, at least in part, by gravity which acts upon the unsupported product stream.

12. The method for sorting as claimed in claim 1, and further comprising locating the product ejector about 50 millimeters to about 150 millimeters downstream of the inspection station.

13. The method for sorting as claimed in claim 4, and wherein the predetermined sequential time periods do not substantially overlap.

* * * * *